US010218085B2

(12) United States Patent
Huang et al.

(10) Patent No.: US 10,218,085 B2
(45) Date of Patent: Feb. 26, 2019

(54) ANTENNA SYSTEM

(71) Applicant: Wistron NeWeb Corp., Hsinchu (TW)

(72) Inventors: Po-Hsun Huang, Hsinchu (TW); Yu Tao, Hsinchu (TW); Chung-Yen Hsiao, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 240 days.

(21) Appl. No.: 15/370,282

(22) Filed: Dec. 6, 2016

(65) Prior Publication Data

US 2018/0159226 A1 Jun. 7, 2018

(51) Int. Cl.

| | |
|---|---|
| ***H01Q 21/28*** | (2006.01) |
| ***H01Q 1/24*** | (2006.01) |
| ***H01Q 1/48*** | (2006.01) |
| ***H01Q 3/24*** | (2006.01) |
| ***H01Q 9/42*** | (2006.01) |
| ***H01Q 5/321*** | (2015.01) |
| ***H01Q 5/371*** | (2015.01) |
| *H01Q 1/22* | (2006.01) |

(52) U.S. Cl.

CPC ..... *H01Q 21/28* (2013.01); *H01Q 1/243* (2013.01); *H01Q 1/48* (2013.01); *H01Q 3/24* (2013.01); *H01Q 5/321* (2015.01); *H01Q 5/371* (2015.01); *H01Q 9/42* (2013.01); *H01Q 1/2291* (2013.01)

(58) Field of Classification Search

CPC ..... H01Q 1/243; H01Q 1/48; H01Q 3/24; H01Q 5/321; H01Q 5/328; H01Q 5/335; H01Q 5/35; H01Q 5/371; H01Q 9/0421; H01Q 9/42; H01Q 21/28

See application file for complete search history.

(56) References Cited

U.S. PATENT DOCUMENTS

| | | | | |
|---|---|---|---|---|
| 2008/0007468 | A1* | 1/2008 | Sato | H01Q 1/243 343/702 |
| 2009/0251381 | A1* | 10/2009 | Chou | H01Q 1/48 343/846 |
| 2010/0214175 | A1* | 8/2010 | Hui | H01Q 1/243 343/700 MS |

* cited by examiner

*Primary Examiner* — Robert Karacsony

(74) *Attorney, Agent, or Firm* — McClure, Qualey & Rodack, LLP

(57) ABSTRACT

An antenna system includes a ground element, a switch element, a first antenna, and a second antenna. The switch element is selectively closed or opened according to a control signal. The first antenna has a first feeding terminal. The first feeding terminal of the first antenna is coupled to a first signal source. The second antenna has a second feeding terminal and a grounding terminal. The second feeding terminal of the second antenna is coupled through the switch element to a second signal source. The grounding terminal of the second antenna is coupled to the ground element.

19 Claims, 7 Drawing Sheets

ANTENNA SYSTEM

BACKGROUND OF THE INVENTION

Field of the Invention

The disclosure relates generally to an antenna system, and more particularly, to an antenna system with high radiation efficiency.

Description of the Related Art

With advancements in mobile communication technology, mobile devices such as signal trackers, GPS (Global Positioning System) trackers, portable computers, mobile phones, multimedia players, and other hybrid functional portable electronic devices have become more common. To satisfy consumer demand, mobile devices can usually perform wireless communication functions. Some devices cover a large wireless communication area; these include mobile communication devices using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile communication devices using Wi-Fi and Bluetooth systems and using frequency bands of 2.4 GHz, 5.2 GHz, and 5.8 GHz.

Antennas are indispensable elements for wireless communication. If an antenna for signal reception and transmission has poor radiation efficiency, it will degrade the communication quality of the mobile device. Accordingly, it has become a critical challenge for antenna designers to design an antenna system with wide bandwidth and high radiation efficiency.

BRIEF SUMMARY OF THE INVENTION

In an exemplary embodiment, the disclosure is directed to an antenna system including a ground element, a switch element, a first antenna, and a second antenna. The switch element is selectively closed or opened according to a control signal. The first antenna has a first feeding terminal. The first feeding terminal of the first antenna is coupled to a first signal source. The second antenna has a second feeding terminal and a grounding terminal. The second feeding terminal of the second antenna is coupled through the switch element to a second signal source. The grounding terminal of the second antenna is coupled to the ground element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
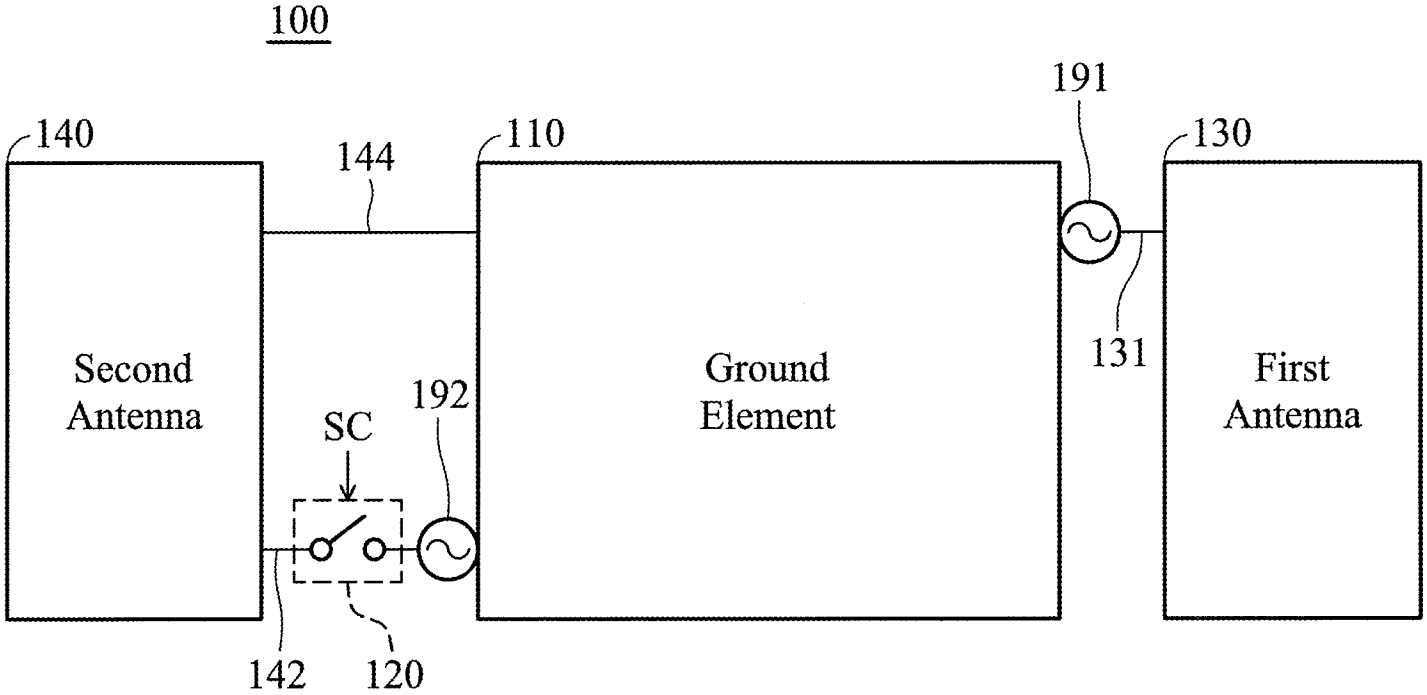
FIG. 1 is a diagram of an antenna system according to an embodiment of the invention.

FIG. 1 is a diagram of an antenna system 100 according to an embodiment of the invention. The antenna system 100 may be applied in a mobile device, such as a signal tracker or a GPS (Global Positioning System) tracker. As shown in FIG. 1, the antenna system 100 includes a ground element 110, a switch element 120, a first antenna 130, and a second antenna 140. The ground element 110 may be a ground metal plate. The switch element 120 is selectively closed or opened according to a control signal SC. The control signal SC may be generated by a processor (not shown) according to a user's input. The types and shapes of the first antenna 130 and the second antenna 140 are not limited in the invention. For example, the first antenna 130 may be a monopole antenna, a dipole antenna, a patch antenna, a helical antenna, or a PIFA (Planar Inverted F Antenna), and the second antenna 140 may be a PIFA as well. The first antenna 130 has a first feeding terminal 131. The first feeding terminal 131 of the first antenna 130 is coupled to a first signal source 191. The second antenna 140 has a second feeding terminal 142 and a grounding terminal 144. The second feeding terminal 142 of the second antenna 140 is coupled through the switch element 120 to a second signal source 192. The grounding terminal 144 of the second antenna 140 is coupled to the ground element 110. The first signal source 191 and the second signal source 192 are RF (Radio Frequency) modules operating in the same frequency bands, and they are configured to excite the first antenna 130 and the second antenna 140, respectively. Generally, the antenna system 100 can operate in two different modes in response to the switching state of the switch element 120. In a dual-antenna mode, the switch element 120 is closed, and the second antenna 140 is excited and configured to increase the diversity gain of the antenna system 100. In a single-antenna mode, the switch element 120 is opened, and the second antenna 140 is not excited and is configured as an extension portion of the ground element 110, so as to increase the radiation efficiency of the first antenna 130. In other words, the proposed antenna system 100 can improve either the diversity gain or the radiation efficiency.

The following embodiments and figures will describe the detailed structures and radiation branches of the antenna system 100. It should be understood that these embodiments and figures are merely exemplary, rather than restricted limitations of the invention.

Figure 2A:
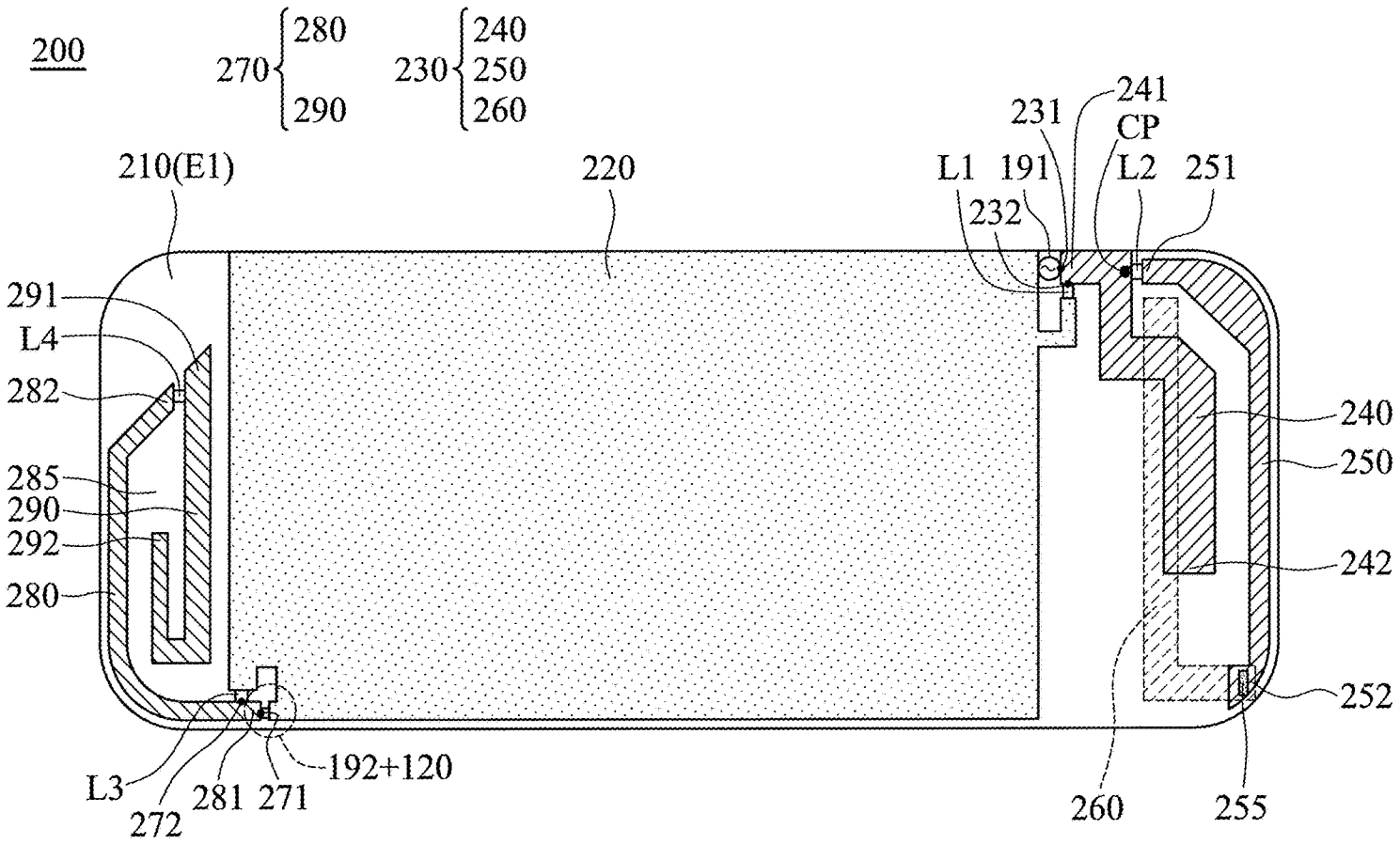
FIG. 2A is a front view of an antenna system according to an embodiment of the invention.
Figure 2B:
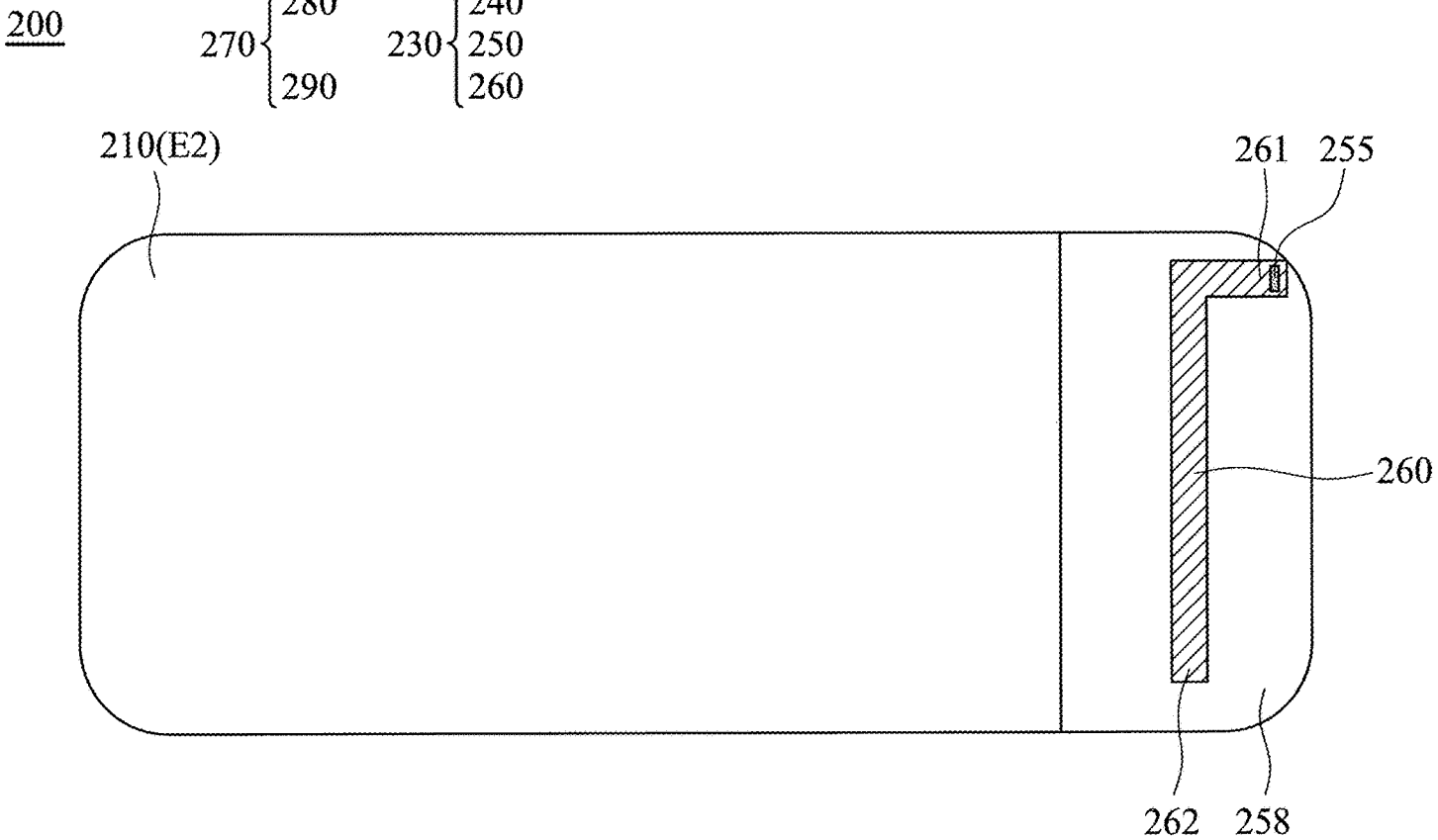
FIG. 2B is a back view of an antenna system according to an embodiment of the invention.
Figure 2C:
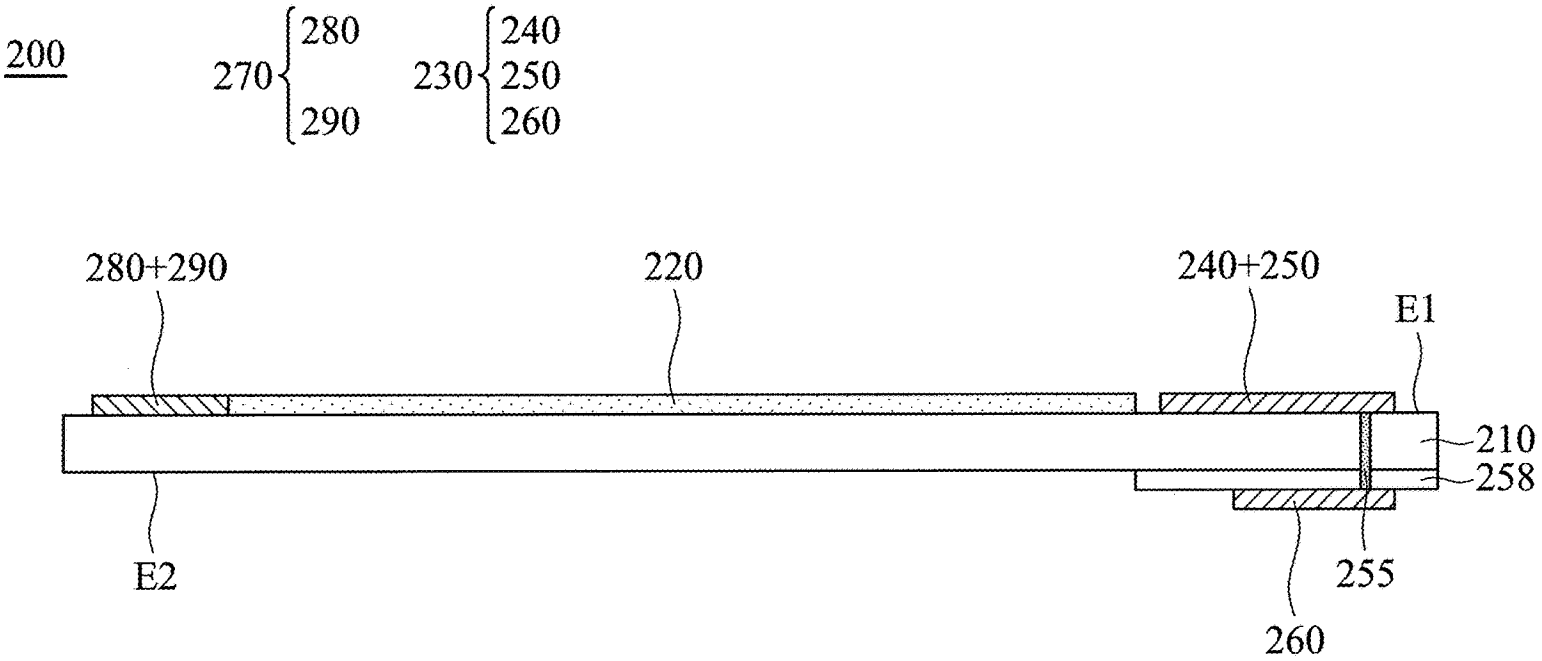
FIG. 2C is a side view of an antenna system according to an embodiment of the invention.

FIG. 2A is a front view of an antenna system 200 according to an embodiment of the invention. FIG. 2B is a back view of the antenna system 200 according to an embodiment of the invention. FIG. 2C is a side view of the antenna system 200 according to an embodiment of the invention. In the embodiment of FIG. 2A, FIG. 2B, and FIG. 2C, the antenna system 200 includes a dielectric substrate 210, a switch element 120, a ground element 220, a first antenna 230, and a second antenna 270. The first antenna 230 may be used as a main antenna, and the second antenna 270 may be used as an auxiliary antenna. Both the first antenna 230 and the second antenna 270 can cover the same low-frequency band and high-frequency band. The dielectric substrate 210 may be an FR4 (Flame Retardant 4) substrate, in which the dielectric substrate 210 has a first surface E1 and a second surface E2 opposite to the first surface E1. The ground element 220, at least a portion of the first antenna 230, and the second antenna 270 may be disposed on the first surface E1 of the dielectric substrate 210. The other portion of the first antenna 230 may be disposed on the second surface E2 of the dielectric substrate 210. The switch element 120 is selectively closed or opened according to a control signal. Each of the first antenna 230 and the second antenna 270 is a PIFA (Planar Inverted F Antenna). The first antenna 230 has a first feeding terminal 231 coupled to a first signal source 191, and a first grounding terminal 232 coupled to the ground element 220. The second antenna 270 has a second feeding terminal 271 coupled through the switch element 120 to a second signal source 192, and a second grounding terminal 272 coupled to the ground element 220. The first signal source 191 and the second signal source 192 are RF (Radio Frequency) modules for exciting the first antenna 230 and the second antenna 270, respectively.

The first antenna 230 includes a first radiation branch 240, a second radiation branch 250, and a third radiation branch 260. The first radiation branch 240 is coupled to the first signal source 191 and the ground element 220. The third radiation branch 260 is coupled through the second radiation branch 250 to the first radiation branch 240. The first radiation branch 240 and the second radiation branch 250 are disposed on the first surface E1 of the dielectric substrate 210, and the third radiation branch 260 is disposed on the second surface E2 of the dielectric substrate 210. The first radiation branch 240 may have a first meandering structure, such as a W-shape, and it may be positioned between the second radiation branch 250 and the ground element 220. The first radiation branch 240 has a first end 241 and a second end 242. The first end 241 of the first radiation branch 240 has a first feeding terminal 231 and a first grounding terminal 232. The first feeding terminal 231 of the first end 241 of the first radiation branch 240 is coupled to the first signal source 191. The first grounding terminal 232 of the first end 241 of the first radiation branch 240 is coupled to the ground element 220. The second end 242 of the first radiation branch 240 is open. The second radiation branch 250 may have a second meandering structure, such as a U-shape. The second radiation branch 250 has a first end 251 and a second end 252. The first end 251 of the second radiation branch 250 is coupled to a connection point CP of the first radiation branch 240. The second end 252 of the second radiation branch 250 extends from the connection point CP and the second radiation branch 250 at least partially surrounds the first radiation branch 240. The third radiation branch 260 may have a third meandering structure, such as an L-shape. The third radiation branch 260 has a first end 261 and a second end 262. The first end 261 of the third radiation branch 260 is coupled through a via element 255 to the second end 252 of the second radiation branch 250. The second end 262 of the third radiation branch 260 is open. The via element 255 may be penetrated through the dielectric substrate 210. The third radiation branch 260 has a vertical projection at least partially overlapping the first radiation branch 240. Such a design can enhance the coupling effect between the first radiation branch 240 and the third radiation branch 260, so as to increase the high-frequency bandwidth of the first antenna 230.

In some embodiments, the first antenna 230 further includes a first inductor L1 and a second inductor L2, which may be chip inductors. The first inductor L1 is coupled between the first grounding terminal 232 of the first end 241 of the first radiation branch 240 and the ground element 220. The first inductor L1 is configured to adjust the high-frequency impedance matching of the first antenna 230. The inductance of the first inductor L1 may be from about 6 nH to about 9 nH. The second inductor L2 is coupled between the first end 251 of the second radiation branch 250 and the connection point CP on the first radiation branch 240. The second inductor L2 is configured to reject the high-frequency currents, thereby separating the high-frequency resonant path from the low-frequency resonant path of the first antenna 230. The inductance of the second inductor L2 may be from about 6 nH to about 9 nH. The above inductance ranges are based on many experiment results, and they can be used to fine-tune the operation frequency of the first antenna 230. It should be noted that the first inductor L1 and the second inductor L2 are optional elements. In alternative embodiments, the first inductor L1 and the second inductor L2 are removed, such that the first end 241 of the first radiation branch 240 is directly connected to the ground element 220, and the first end 251 of the second radiation branch 250 is directly connected to the connection point CP on the first radiation branch 240.

In some embodiments, the first antenna 230 further includes a supporting plate 258. The supporting plate 258 is made of a nonconductive material, such as a plastic material, and it may have a substantially rectangular shape and cover about a quarter of the second surface E2 of the dielectric substrate 210. The supporting plate 258 is disposed between the third radiation branch 260 and the second surface E2 of the dielectric substrate 210. The third radiation branch 260 is disposed on the supporting plate 258. The via element 255 may be formed through the supporting plate 258 and the dielectric substrate 210. The supporting plate 258 is configured to support and fix the third radiation branch 260, and adjust the coupling gap between the first radiation branch 240 and the third radiation branch 260. It should be noted that the supporting plate 258 is an optional element. In alternative embodiments, the supporting plate 258 can be removed, such that the third radiation branch 260 can be disposed directly on the second surface E2 of the dielectric substrate 210.

The second antenna 270 includes a fourth radiation branch 280 and a fifth radiation branch 290. The fourth radiation branch 280 is coupled to the switch element 120 and the ground element 220. The fifth radiation branch 290 is coupled to the fourth radiation branch 280. The fourth radiation branch 280 has a fourth meandering structure, such as a C-shape. The fourth radiation branch 280 has a first end 281 and a second end 282. The first end 281 of the fourth radiation branch 280 has a second feeding terminal 271 and a second grounding terminal 272. The second feeding terminal 271 of the first end 281 of the fourth radiation branch 280 is coupled through the switch element 120 to the second signal source 192. The second grounding terminal 272 of the first end 281 of the fourth radiation branch 280 is coupled to the ground element 220. The fifth radiation branch 290 has a fifth meandering structure, such as a J-shape. The fifth radiation branch 290 has a first end 291 and a second end 292. The first end 291 of the fifth radiation branch 290 is coupled to the second end 282 of the fourth radiation branch 280. The second end 292 of the fifth radiation branch 290 is open. Specifically, the fourth radiation branch 280 and the fifth radiation branch 290 together define a notch 285, and the second end 292 of the fifth radiation branch 290 extends into an interior of the notch 285 to form a substantial spiral shape, so as to minimize the total size of the second antenna 270.

According to an embodiment of the present invention, the second antenna 270 further includes a third inductor L3 and a fourth inductor L4, which may be chip inductors. The third inductor L3 is coupled between the second grounding terminal 272 of the first end 281 of the fourth radiation branch 280 and the ground element 220. The third inductor L3 is configured to adjust the high-frequency impedance matching of the second antenna 270. The inductance of the third inductor L3 may be from about 6 nH to about 9 nH. The fourth inductor L4 is coupled between the second end 282 of the fourth radiation branch 280 and the first end 291 of the fifth radiation branch 290. The fourth inductor L4 is configured to reject the high-frequency currents, thereby separating the high-frequency resonant path from the low-frequency resonant path of the second antenna 270. The inductance of the fourth inductor IA may be from about 10 nH to about 18 nH. The above ranges of inductances are determined based on many experiment results, and they can fine-tune the operation frequency of the second antenna 270. It should be noted that the third inductor L3 and the fourth inductor L4 are optional elements. In alternative embodiments, the third inductor L3 and the fourth inductor IA are removed, such that the second grounding terminal 272 of the first end 281 of the fourth radiation branch 280 is directly connected to the ground element 220, and the first end 291 of the fifth radiation branch 290 is directly connected to the second end 282 of the fourth radiation branch 280.

Figure 3:
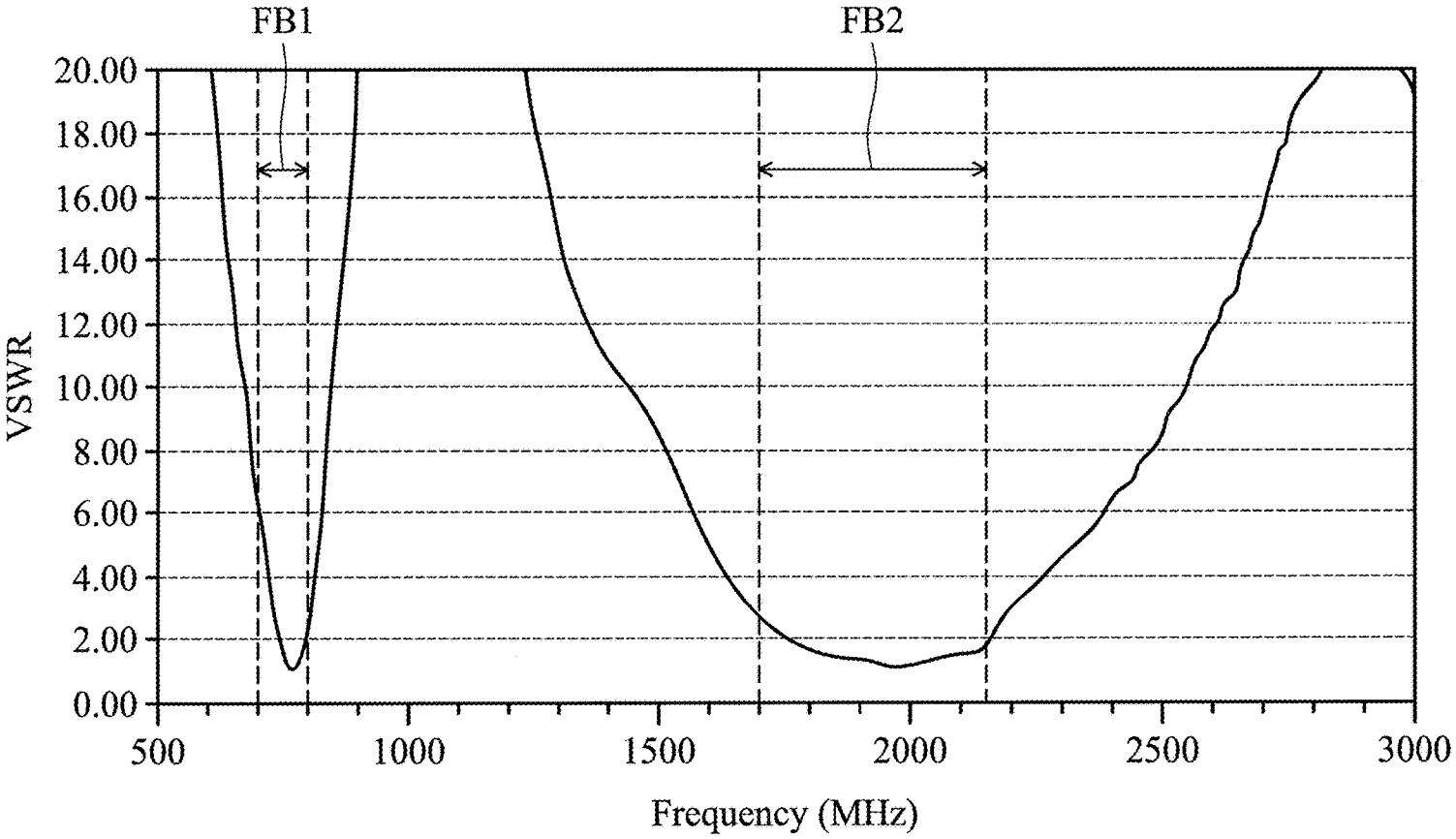
FIG. 3 is a diagram of VSWR (Voltage Standing Wave Ratio) of an antenna system according to an embodiment of the invention.

FIG. 3 is a diagram of VSWR (Voltage Standing Wave Ratio) of the antenna system 200 according to an embodiment of the invention. The horizontal axis represents the operational frequency (MHz), and the vertical axis represents the VSWR. According to the measurement of FIG. 3, each of the first antenna 230 and the second antenna 270 can cover a low-frequency band FB1 from about 700 MHz to about 800 MHz, and a high-frequency band FB2 from about 1700 MHz to about 2150 MHz. Therefore, the antenna system 200 can support at least the wideband operation of LTE (Long Term Evolution) Band 13, Band 2, and Band 4. In some embodiments, the element sizes of the antenna system 200 are as follows: The effective resonant length of the combination of the second inductor L2, the second radiation branch 250, and the third radiation branch 260 may be equal to 0.25 wavelength (λ/4) of the low-frequency band FB1. The length of the first radiation branch 240 may be equal to 0.25 wavelength (λ/4) of the high-frequency band FB2. The effective resonant length of the combination of the fourth radiation branch 280, the fourth inductor L4, and the fifth radiation branch 290 may be equal to 0.25 wavelength (λ/4) of the low-frequency band FB1. The length of the fourth radiation branch 280 may be equal to 0.25 wavelength (λ4) of the high-frequency band FB2.

Figure 4A:
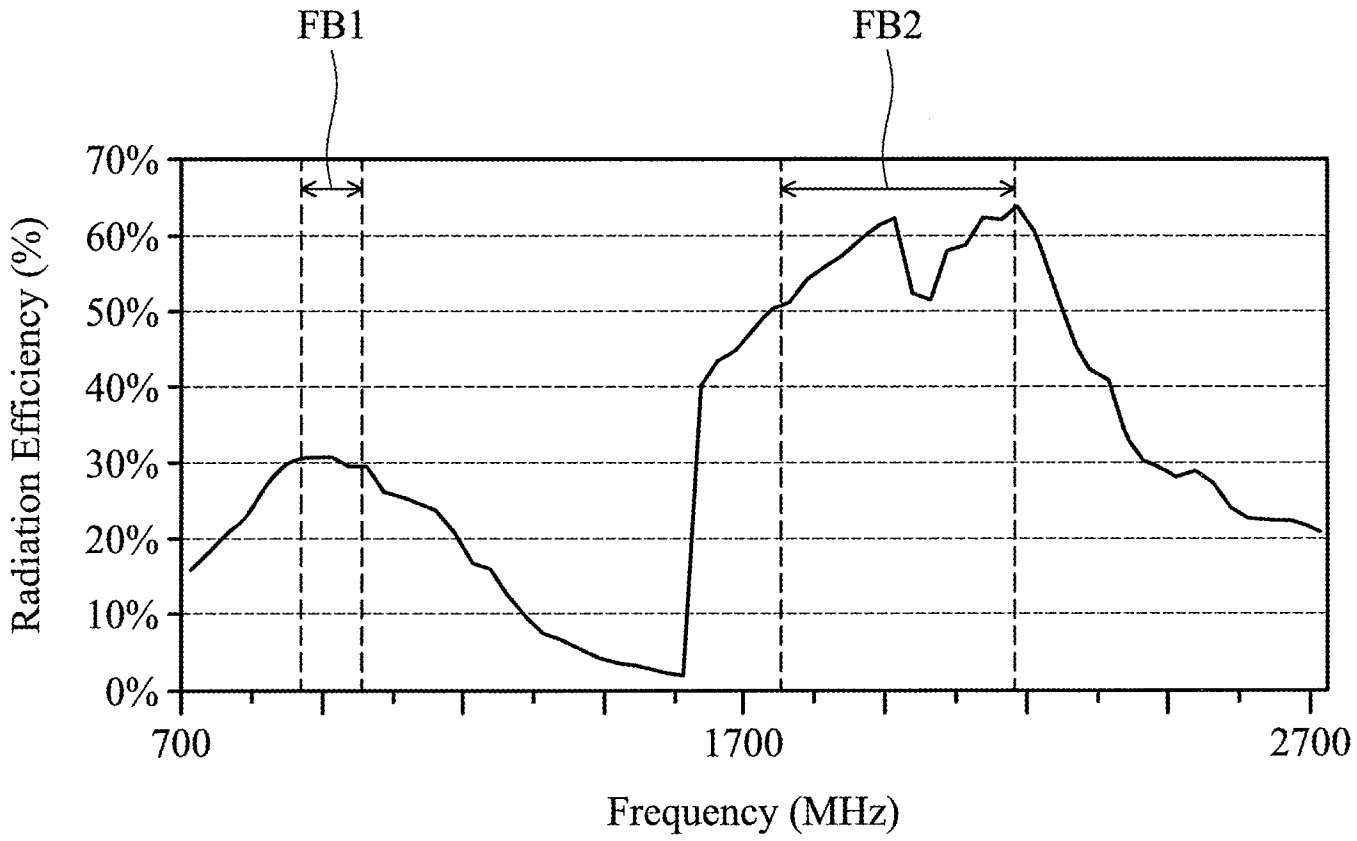
FIG. 4A is diagram of radiation efficiency of a first antenna when a switch element is closed, according to an embodiment of the invention.

FIG. 4A is diagram of radiation efficiency of the first antenna 230 when the switch element 120 is closed, according to an embodiment of the invention. The horizontal axis represents the operation frequency (MHz), and the vertical axis represents the radiation efficiency (%). In the embodiment of FIG. 4A, the switch element 120 is closed, and both the first antenna 230 and the second antenna 270 are excited. According to the practical measurement of FIG. 4A, the antenna efficiency of the first antenna 230 is about 30% in the low-frequency band FB1, and is about 60% in the high-frequency band FB2.

Figure 4B:
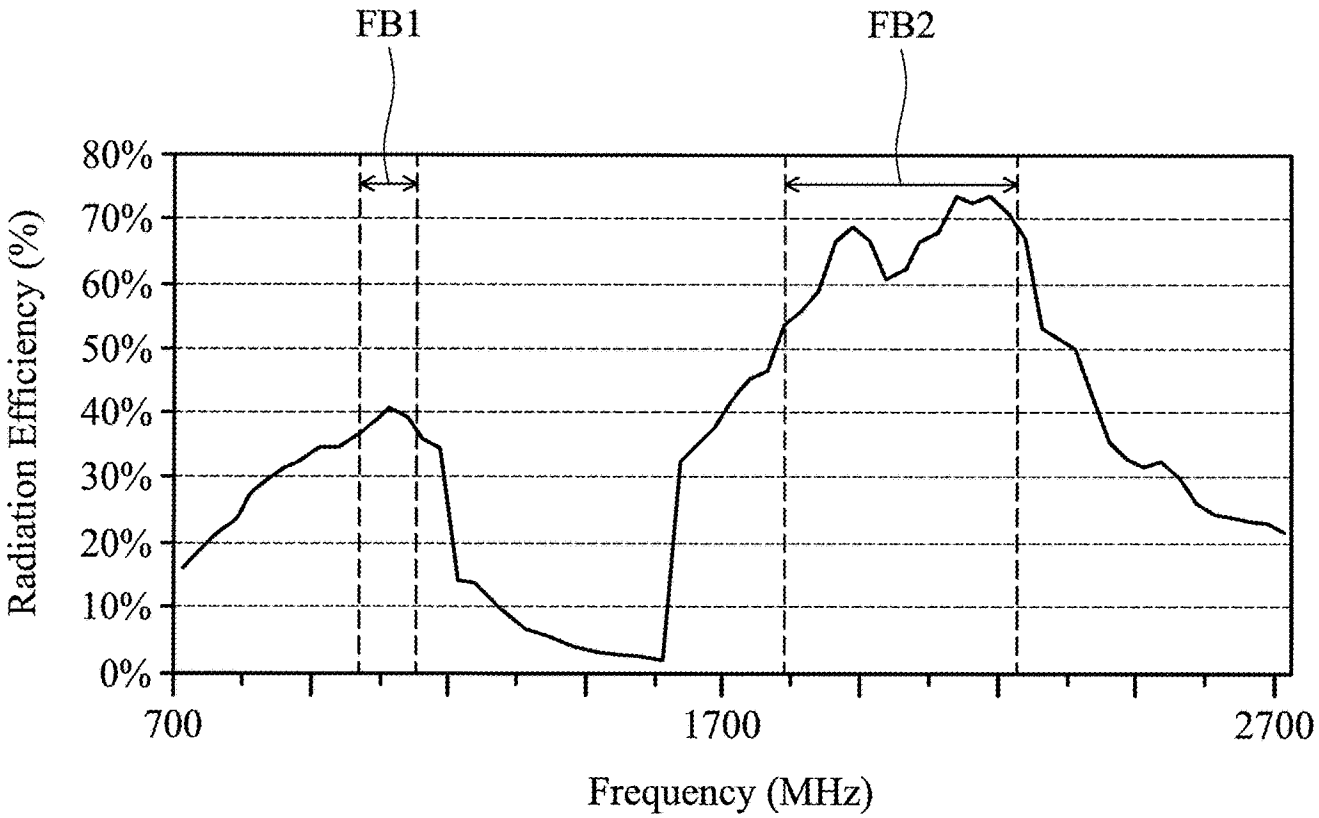
FIG. 4B is diagram of radiation efficiency of a first antenna when a switch element is opened, according to an embodiment of the invention.

FIG. 4B is diagram of radiation efficiency of the first antenna 230 when the switch element 120 is opened, according to an embodiment of the invention. The horizontal axis represents the operation frequency (MHz), and the vertical axis represents the radiation efficiency (%). In the embodiment of FIG. 4B, the switch element 120 is opened, and only the first antenna 230 is excited. The second antenna 270 is not excited, and it is configured as an extension portion of the ground element 220. According to the practical measurement of FIG. 4B, the antenna efficiency of the first antenna 230 is about 40% in the low-frequency band FB1, and is about 65% in the high-frequency band FB2. That is, if the second antenna 270 is used as the extension portion of the ground element 220, it can improve the low-frequency radiation efficiency of the first antenna 230 by about 10% because the low-frequency resonant path of the first antenna 230 requires a longer resonant length of the ground element 220. In addition, the antenna efficiency of the first antenna 230 in the high-frequency band FB2 is also slightly improved.

The embodiments of the invention propose a novel antenna system. In comparison to the conventional antenna design, the proposed antenna system has at least the advantages of: (1) being a planar antenna design, (2) being easy to manufacture a large amount of identical products, (3) covering the wideband operation of the LTE frequency bands, and (4) enhancing either the diversity gain or the radiation efficiency. Therefore, the proposed antenna system is suitable for application in a variety of small-size mobile communication devices.

Note that the above element sizes, element parameters, element shapes, and frequency ranges are not limitations of the invention. An antenna designer can fine-tune these settings or values according to different requirements. It should be understood that the antenna system of the invention is not limited to the configurations of FIGS. 1-4. The invention may merely include any one or more features of any one or more embodiments of FIGS. 1-4. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a ground element;

a switch element, selectively closed or opened according to a control signal;

a first antenna, having a first feeding terminal, wherein the first feeding terminal of the first antenna is coupled to a first signal source; and a second antenna, having a second feeding terminal and a grounding terminal, wherein the second feeding terminal of the second antenna is coupled through the switch element to a second signal source, and the grounding terminal of the second antenna is coupled to the ground element;

wherein the first antenna comprises a first radiation branch, a second radiation branch, and a third radiation branch, the first radiation branch is coupled to the first signal source and the ground element, and the third radiation branch is coupled through the second radiation branch to the first radiation branch.

2. The antenna system as claimed in claim 1, wherein the second antenna is a PIFA (Planar Inverted F Antenna).

3. The antenna system as claimed in claim 1, wherein when the switch element is closed, the second antenna is configured to increase diversity gain of the antenna system.

4. The antenna system as claimed in claim 1, wherein when the switch element is opened, the second antenna is configured as an extension portion of the ground element, so as to increase radiation efficiency of the first antenna.

5. The antenna system as claimed in claim 1, wherein when the switch element is closed, the first antenna is used as a main antenna and the second antenna is used as an auxiliary antenna, and both the first antenna and the second antenna cover a low-frequency band from about 700 MHz to about 800 MHz and a high-frequency band from about 1700 MHz to about 2150 MHz.

6. The antenna system as claimed in claim 1, further comprising:

a dielectric substrate, having a first surface and a second surface opposite to the first surface, wherein the ground element, at least a portion of the first antenna, and the second antenna are disposed on the first surface of the dielectric substrate, and wherein the other portion of the first antenna is disposed on the second surface of the dielectric substrate.

7. The antenna system as claimed in claim 6, wherein the first radiation branch and the second radiation branch are disposed on the first surface of the dielectric substrate, and the third radiation branch is disposed on the second surface of the dielectric substrate.

8. The antenna system as claimed in claim 7, wherein a vertical projection of the third radiation branch at least partially overlaps the first radiation branch.

9. The antenna system as claimed in claim 6, wherein the first radiation branch has a first end and a second end, the first end of the first radiation branch is coupled to the first signal source and the ground element, and the second end of the first radiation branch is open.

10. The antenna system as claimed in claim 9, wherein the first antenna further comprises a first inductor coupled between the first end of the first radiation branch and the ground element.

11. The antenna system as claimed in claim 6, wherein the second radiation branch has a first end and a second end, the first end of the second radiation branch is coupled to the first radiation branch, and the second end of the second radiation branch extends from where the second radiation branch couples to the first radiation branch, and the second radiation branch at least partially surrounds the first radiation branch.

12. The antenna system as claimed in claim 11, wherein the first antenna further comprises a second inductor coupled between the first end of the second radiation branch and the first radiation branch.

13. The antenna system as claimed in claim 6, wherein the third radiation branch has a first end and a second end, the first end of the third radiation branch is coupled through a via element to the second end of the second radiation branch, and the second end of the third radiation branch is open.

14. The antenna system as claimed in claim 13, further comprising:

a supporting plate, disposed between the third radiation branch of the first antenna and the second surface of the dielectric substrate, the third radiation branch is disposed on the supporting plate, and the via element is penetrated through the supporting plate and the dielectric substrate.

15. The antenna system as claimed in claim 1, wherein the second antenna comprises a fourth radiation branch and a fifth radiation branch, the fourth radiation branch is coupled to the switch element and the ground element, and the fifth radiation branch is coupled to the fourth radiation branch.

16. The antenna system as claimed in claim 15, wherein the fourth radiation branch has a first end and a second end, and the first end of the fourth radiation branch is coupled to the switch element and the ground element.

17. The antenna system as claimed in claim 16, wherein the second antenna further comprises a third inductor coupled between the first end of the fourth radiation branch and the ground element.

18. The antenna system as claimed in claim 16, wherein the fifth radiation branch has a first end and a second end, the first end of the fifth radiation branch is coupled to the second end of the fourth radiation branch, and the second end of the fifth radiation branch is open.

19. The antenna system as claimed in claim 18, wherein the second antenna further comprises a fourth inductor coupled between the second end of the fourth radiation branch and the first end of the fifth radiation branch.

* * * * *